US006192723B1

(12) United States Patent
Brownell, Sr.

(10) Patent No.: US 6,192,723 B1
(45) Date of Patent: Feb. 27, 2001

(54) GATE LOCK

(76) Inventor: Richard Gerry Brownell, Sr., 1985 State Rte. 40, Greenwich, NY (US) 12834

( * ) Notice: Subject to any disclaimer, the term of this patent is extended or adjusted under 35 U.S.C. 154(b) by 0 days.

(21) Appl. No.: 09/232,519

(22) Filed: Jan. 19, 1999

(51) Int. Cl.[7] ..... E05B 65/06; E05B 65/08

(52) U.S. Cl. ..... 70/97; 70/279.1; 292/144; 292/169.14; 292/335

(58) Field of Search ..... 70/96–98, 279.1, 70/DIG. 42; 292/169.14, 169.15, 169.17, 169.19, 144, 335, DIG. 62

(56) References Cited

U.S. PATENT DOCUMENTS

| | | | | |
|---|---|---|---|---|
| 1,015,640 | * | 1/1912 | Sallstrom | 292/335 |
| 1,212,569 | * | 1/1917 | Segal | 292/335 |
| 1,220,448 | * | 3/1917 | Parker et al. | 292/335 |
| 1,231,486 | | 6/1917 | Brown . | |
| 1,501,228 | * | 7/1924 | Martin | 292/335 |
| 1,692,295 | | 11/1928 | Gerard . | |
| 1,768,021 | * | 6/1930 | Bauerband | 292/333 X |
| 1,970,807 | * | 8/1934 | Lovell | 70/283 |
| 2,158,088 | * | 5/1939 | Segal | 292/335 |
| 3,603,630 | * | 9/1971 | Check | 292/169.15 |
| 4,180,287 | | 12/1979 | Youngblood et al. | 292/144 |
| 4,406,486 | | 9/1983 | White | 292/144 |
| 4,854,619 | | 8/1989 | Nakauchi | 292/335 |
| 4,884,654 | * | 12/1989 | Durigon | 292/144 X |
| 5,566,991 | | 10/1996 | Young | 292/201 |

FOREIGN PATENT DOCUMENTS

| | | | | |
|---|---|---|---|---|
| 610925 | * | 12/1960 | (CA) | 292/335 |
| 18238 | * | 12/1913 | (DK) | 292/169.15 |

* cited by examiner

*Primary Examiner*—Lloyd A. Gall
(74) *Attorney, Agent, or Firm*—Schmeiser, Olsen & Watts

(57) ABSTRACT

A gate locking mechanism for receiving either a sliding or swing gate. The gate locking mechanism comprises a control lever with a two position slot for preventing its dead bolt from being forced opened. The lock mechanism comprises a receiving pocket that is open on two sides for receiving a gate tang from multiple directions, and further comprising a trigger mechanism within the receiving pocket that can be triggered by a tang entering the receiving pocket from each direction.

11 Claims, 4 Drawing Sheets

GATE LOCK

BACKGROUND OF THE INVENTION

1. Technical Field

The present invention relates to locking mechanisms, and more specifically relates to a universal gate locking mechanism.

2. Related Art

High security environments often require heavy duty locking mechanisms for securing gates and the like. In a typical high security environment, such as a prison, numerous gate locking devices are required for individual cells, as well as for doorways leading to and from secure areas. A typical system comprises a movable gate that includes a gate latch or tang with a hole, and a locking mechanism for receiving the gate tang and locking the gate shut. Within the locking mechanism is a receiving pocket that actually receives the gate tang and a vertically oriented dead bolt that can be dropped down into the receiving pocket and through the hole in the gate tang to secure the gate. The dead bolt is governed by a lever or other means that is controlled by a mechanical system (e.g., a key) or an electrically driven actuator (e.g., a electrical solenoid, motor, clutch, etc.) within the locking mechanism.

Depending on the actual implementation, a typical high security area may call for different gate designs to meet the specific needs of a particular area. For example, some security gates may be implemented as sliding gates (i.e., ones that slide shut), while others may be implemented as swing gates (i.e., ones that swinig shut). In the past, a different locking mechanism has been required for the particular gate design, whether it be sliding or swinging. This in turn causes a non-uniformity among the locking mechanisms which, among other things, raises the cost of manufacturing, installing, and repairing each of the different types of gate locks.

Another concern with high security gate lock mechanisms relates to security in that the dead bolt that secures the gate closed must be designed such that it cannot be "jimmied" or forced open by an inmate or intruder. In prior designs, locking mechanisms have been known to fail when the dead bolt is jiggled and forced upward. In order to overcome this problem, complicated mechanical devices are often required to ensure that the dead bolt, and the associated control lever, can not be displaced by an external force. Unfortunately, the problem continues to persist and recent designs have only tended to increase design complexity and product costs without providing a foolproof lock.

Accordingly, without a locking mechanism that can universally receive different types of gates and provide a high level of security with a simplified design, gate locking mechanisms will continue to be costly to manufacture and be subject to failure.

SUMMARY OF THE INVENTION

The present invention overcomes the above-mentioned problems by providing a locking system for securing a tang of a gate that includes a lock having a receiving pocket for receiving the gate tang from any of a plurality of directions. Specifically, the receiving pocket includes a first opening for receiving the gate tang from a first direction and a second opening for receiving the gate tang from a second direction. Within the opening is a universal trigger that can be actuated by a gate tang in either direction. Thus, for example, a single locking mechanism can be implemented on either a sliding, gate or a swing gate.

In a second aspect, a locking mechanism is disclosed that comprises a control lever with an opening that will prevent a dead bolt from being jimmied or displaced due to an external force. Specifically, the locking mechanism comprises a dead bolt oriented along a first axis and having a range of motion constrained to the first axis and a control lever that is pivotally moveable for raising and lowering the dead bolt, wherein the control lever includes an opening at one end for receiving a pin on the dead bolt. The opening includes a first slot that allows the control lever to move the dead bolt along the first axis between a locked and unlocked position, and a second slot for restraining movement of the dead bolt from the locked to the unlocked position when an external force is placed onto the dead bolt.

It is therefore an advantage of the present invention to provide a locking mechanism that can receive a gate tang from more than one direction, thereby eliminating the need to alter the configuration to handle different styles of gates. It is therefore a further advantage of the present invention to provide a locking mechanism that can receive a gate tang from either a sliding gate or a swing gate. It is therefore a further advantage of the present invention to provide a control lever coupled to a dead bolt that can move the dead bolt between a locked and unlocked position while preventing the dead bolt from being forced from the locked to the unlocked position.

The foregoing and other objects, features and advantages of the invention will be more apparent in the following and more particular description of the preferred embodiments of the invention as illustrated in the accompanying drawings.

BRIEF DESCRIPTION OF THE DRAWINGS

The preferred exemplary embodiments of the present invention will herein be described in conjunction with the appended drawings, where like designations denote like elements, and.

DETAILED DESCRIPTION OF THE INVENTION

Figure 1:
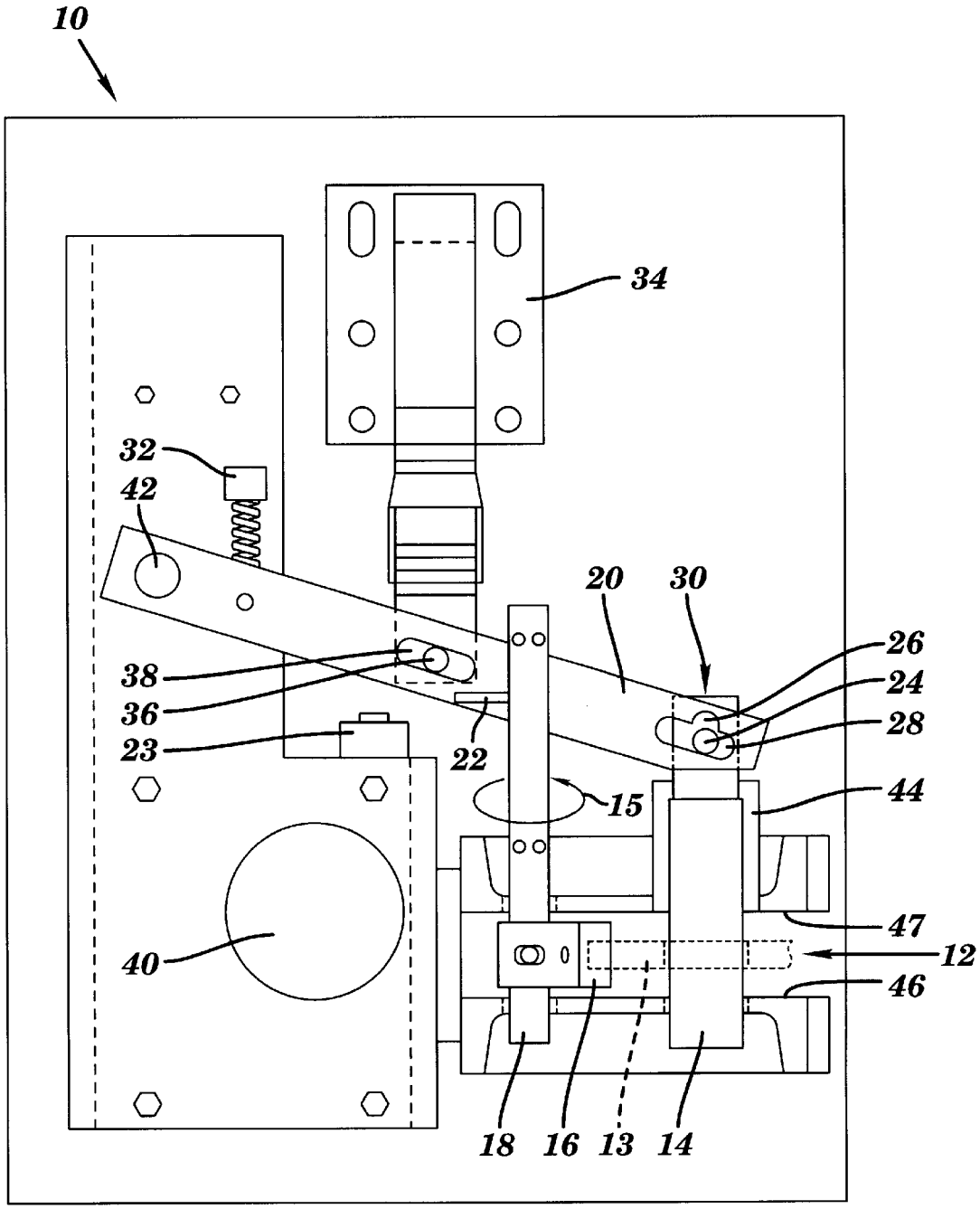
FIG. 1 depicts a front elevation diagram of the locking mechanism with the dead bolt in the locked position in accordance with a preferred embodiment of the present invention.

Referring now to the figures, FIG. 1 depicts a locking mechanism 10 that includes a receiving pocket 12, a dead bolt 14, and a control lever 20. The locking mechanism 10 is shown in the locked position with the dead bolt 14 extended down into the receiving pocket 12 through gate tang 13. This position would be utilized for securing a gate (not shown) connected to the gate tang 13. In general, the gate tang 13 comprises a relatively flat surface that includes a hole through which dead bolt 14 can pass. Receiving pocket 12 comprises a top surface 47 and a bottom surface 46. The receiving pocket 12 is open along both the front and right side to allow either a swing gate or a sliding gate to be utilized with locking mechanism 10 (see FIG. 4). Within receiving pocket 12 is trigger 16 coupled to trigger shaft 18, which is spring biased to push the trigger and gate tang 13 out of the receiving pocket 12. When the gate tang 13 is inserted, as shown, the trigger 16 is pushed in which causes trigger shaft 18 to be rotated along arrow 15. This in turn causes shaft pin 22 to be rotated away from control lever 20 (as shown). The trigger design is universal in that it is rotationally moveable upon contact of the gate tang 13 from either the front or side direction.

Control lever 20, which controls the movement of dead bolt 14, comprises a first end that is mounted to a control lever pivot 42, about which the control lever 20 rotates. The control lever pivot 42 may also comprise a spring 32 that biases the control lever downward to force the dead bolt 14 into the locked position, as shown. The control lever 20 also comprises a central region having a solenoid slot 38 for receiving a solenoid pin 36. The solenoid pin 36 is controlled by solenoid 34 that can be used to remotely raise and lower the control lever 20 about control lever pivot 42 thereby raising dead bolt 14 within the dead bolt 14 retainer 44. Control lever 20 may also be raised with key mechanism 40 and lift 23 that will push the control lever 20 upward. When control lever 20 is moved to the up position, either by solenoid 34 or lift 23, the dead bolt 14 is raised and the trigger shaft 18 rotates along arrow 15 under the force of its spring to push the gate tang 13 out of the receiving pocket 12 and rotate the shaft pin 22 underneath control lever 20. (See FIG. 2.) While the above description provides one possible lock implementation, it is understood that similar implementations utilizing different components could achieve the same or similar functionality, and such equivalent locking structures are within the scope of this invention.

The control lever 20 comprises an opening 30 for coupling the control lever 20 to dead bolt pin 24, which is in turn coupled to dead bolt 14. Thus, dead bolt pin 24 and opening 30 provide the coupling mechanism between the control lever 20 and the dead bolt 14. As can be seen, opening 30 comprises a horizontal slot 28 and a vertical slot 26. The two slots within control lever opening 30 allow the control lever 20 to raise and lower dead bolt 14, while also preventing dead bolt 14 from being forced upward from the locked to unlocked position. This is described in more detail with regard to FIGS. 2 and 3.

Figure 2:
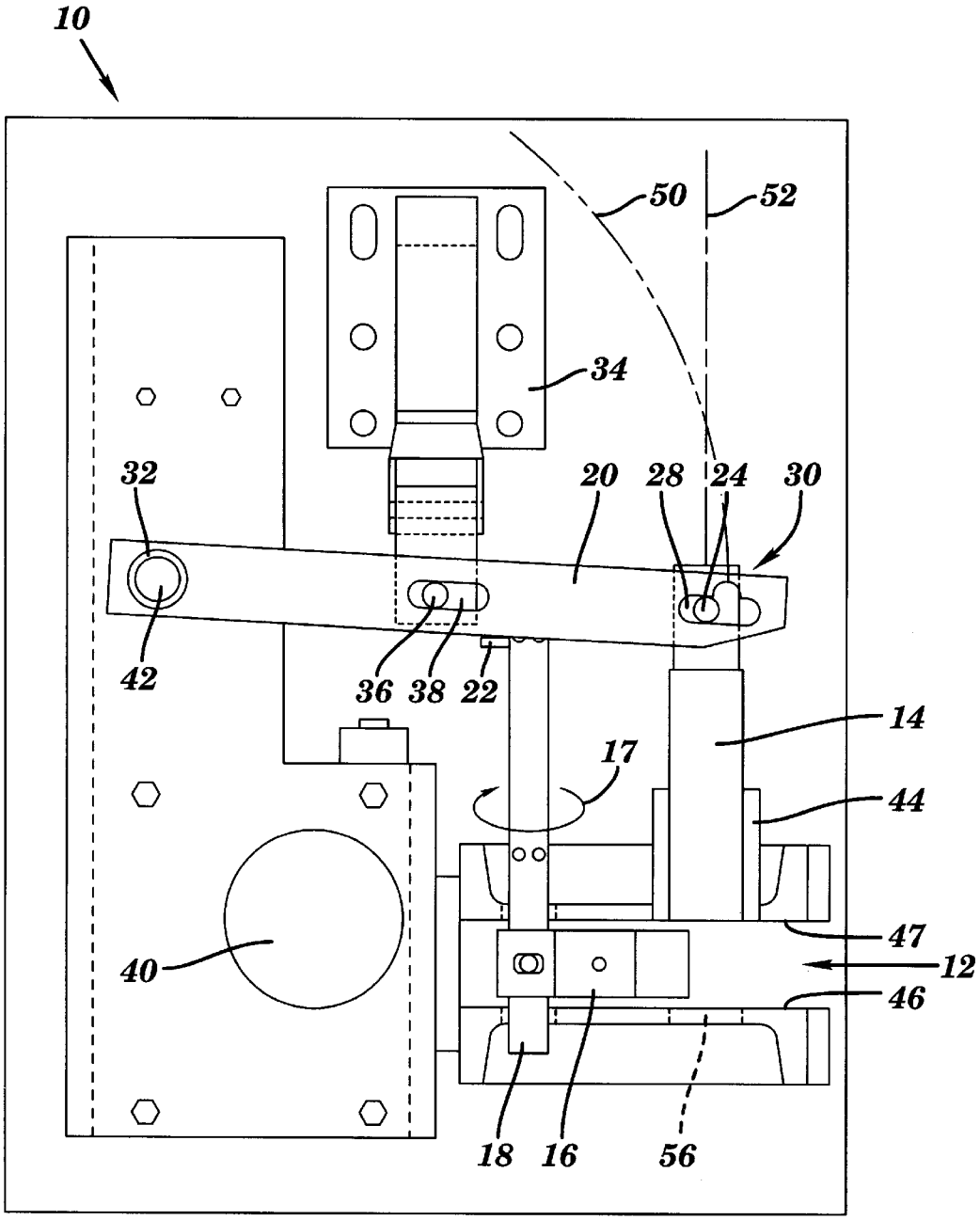
FIG. 2 depicts a front elevation of the locking mechanism with the dead bolt in the unlocked position in accordance with a preferred embodiment of the present invention.

Referring now to FIG. 2, the locking mechanism 10 is depicted in the unlocked position, i.e., the control lever 20 and the dead bolt 14 are raised. As can be seen, the solenoid 34 has raised the solenoid pin 36 upward forcing control lever 20 to raise dead bolt 14. Trigger shaft 18 comprises a spring bias 19 (see FIG. 4) that causes the trigger shaft 18 to rotate about arrow 17 such that trigger 16 is rotated outward and shaft pin 22 is rotated beneath control lever 20. Thus, any time the control lever 20 is raised, shaft pin 22 slides under the control lever 20 and causes the control lever 20 to remain in a raised position thereby keeping the dead bolt 14 in the unlocked position until trigger 16 is actuated by the gate tang 13 (not shown). Accordingly, as shown in FIG. 2, the trigger 16 is positioned in an open position and is ready to receive a gate tang 13.

The locking mechanism 10 is transferred to the closed position when a gate tang 13 is received in the receiving pocket 12. Specifically, when the gate tang 13 contacts trigger 16, trigger shaft 18 rotates in a direction opposite of arrow 17 such that shaft pin 22 slides out from beneath the control lever 20. The control lever 20 is forced downward thanks in part to a spring biasing 32, which forces the dead bolt 14 down through the gate tang 13.

During the lifting of dead bolt 14 (from the locked to unlocked position), control lever opening 30 swings in a circumferential manner along arc 50. During this movement, dead bolt pin 24 is simultaneously raised upwardly and slid laterally within horizontal slot 28. Since control lever 20 has a first limited range of motion (along an arc 50), and dead bolt 14 has a second limited range of motion (i.e., along a vertical axis 52), the horizontal slot 28 is provided to allow control lever 20 to move along the arc 50 and lift dead bolt pin 24 along its vertical axis.

Figure 3:
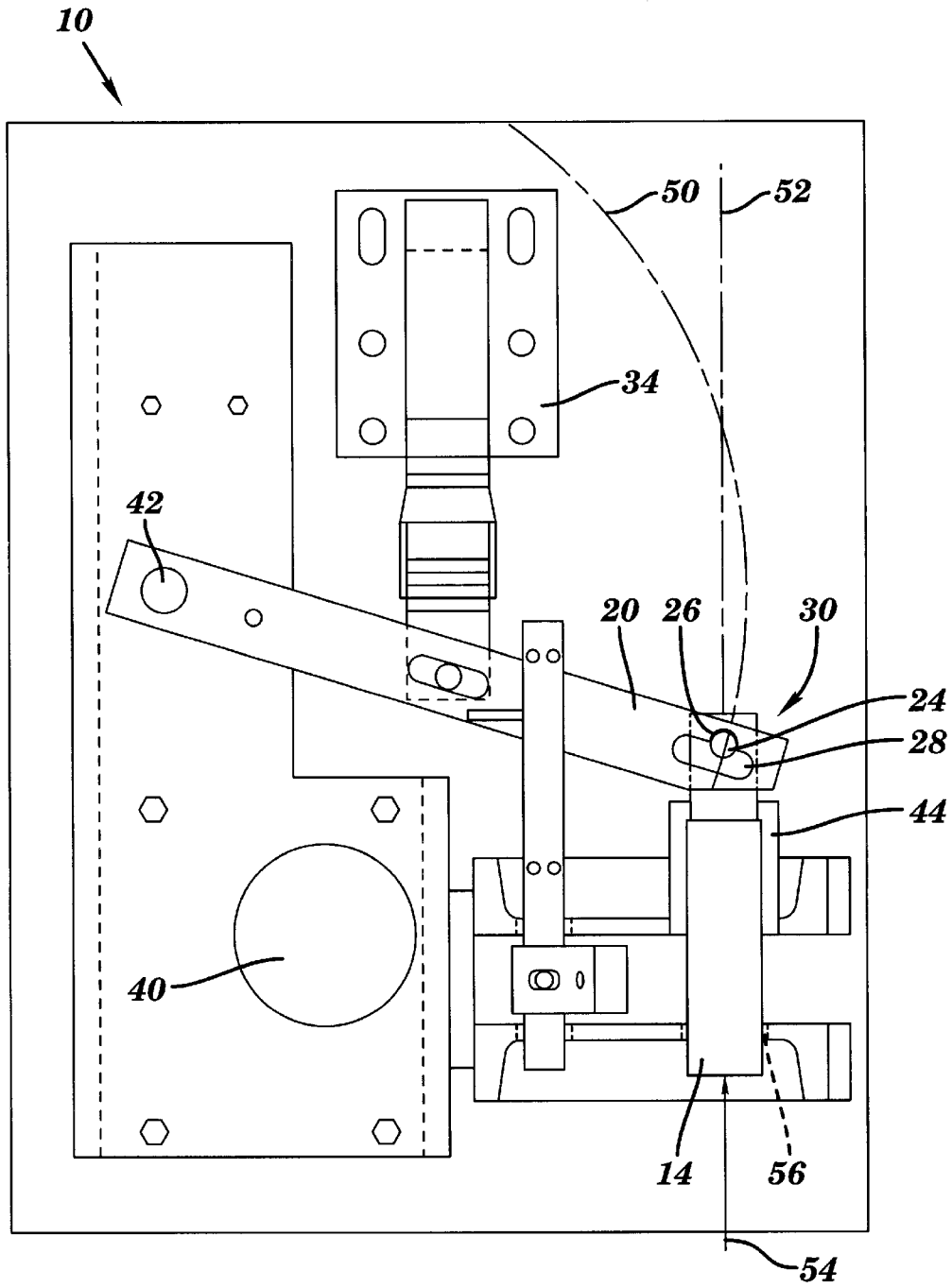
FIG. 3 depicts a front elevation of the locking mechanism with the dead bolt in the locked positioned with a force being applied to the dead bolt in accordance with a preferred embodiment of the present invention.

Referring now to FIG. 3, the locking mechanism 10 is depicted with the dead bolt 14 in the locked position, similar to that shown in FIG. 1. In addition, FIG. 3 demonstrates the locking mechanism 10 with an upward external force 54 applied to dead bolt 14, as would be the case should someone attempt to force the lock open. As can be seen, dead bolt pin 24 is forced up into vertical slot 26, which restrains any further upward movement of the dead bolt. As previously discussed, dead bolt pin 24 is limited in motion along vertical axis 52, due to dead bolt retainer mechanism 44. Conversely, vertical slot 26 is limited in motion to the circumferential path along arc 50 since control lever 20 is pivotally mounted at control lever pivot 42. Accordingly, once dead bolt pin 24 is inserted into vertical slot 26, upward movement of the control lever 20 is stopped since the dead bolt pin can only travel vertically along axis 52 and vertical slot 26 can only travel along arc 50. In summary, dead bolt pin 24 and vertical slot 26 act in concert as a clutch system to prevent the upward independent movement of dead bolt 14 along axis 52, thereby preventing an external force 54 from causing a failure of locking mechanism 10.

Thus, the control lever opening 30 comprises a horizontal slot 28 for allowing the lifting of dead bolt 14 via one of the internal mechanisms (e.g., key 40 or solenoid 34), and a vertical slot 26 for limiting the upward motion of the dead bolt 14 via an external force (e.g., force 54). Both of these functions are achieved with a unique coupling system that eliminates the need for additional componentry and cost. While this preferred embodiment depicts one implementation, it is recognized that other related coupling systems could be implemented within the scope of this invention that take advantage of a control lever having a first range of motion and a dead bolt having a second range of motion.

Figure 4:
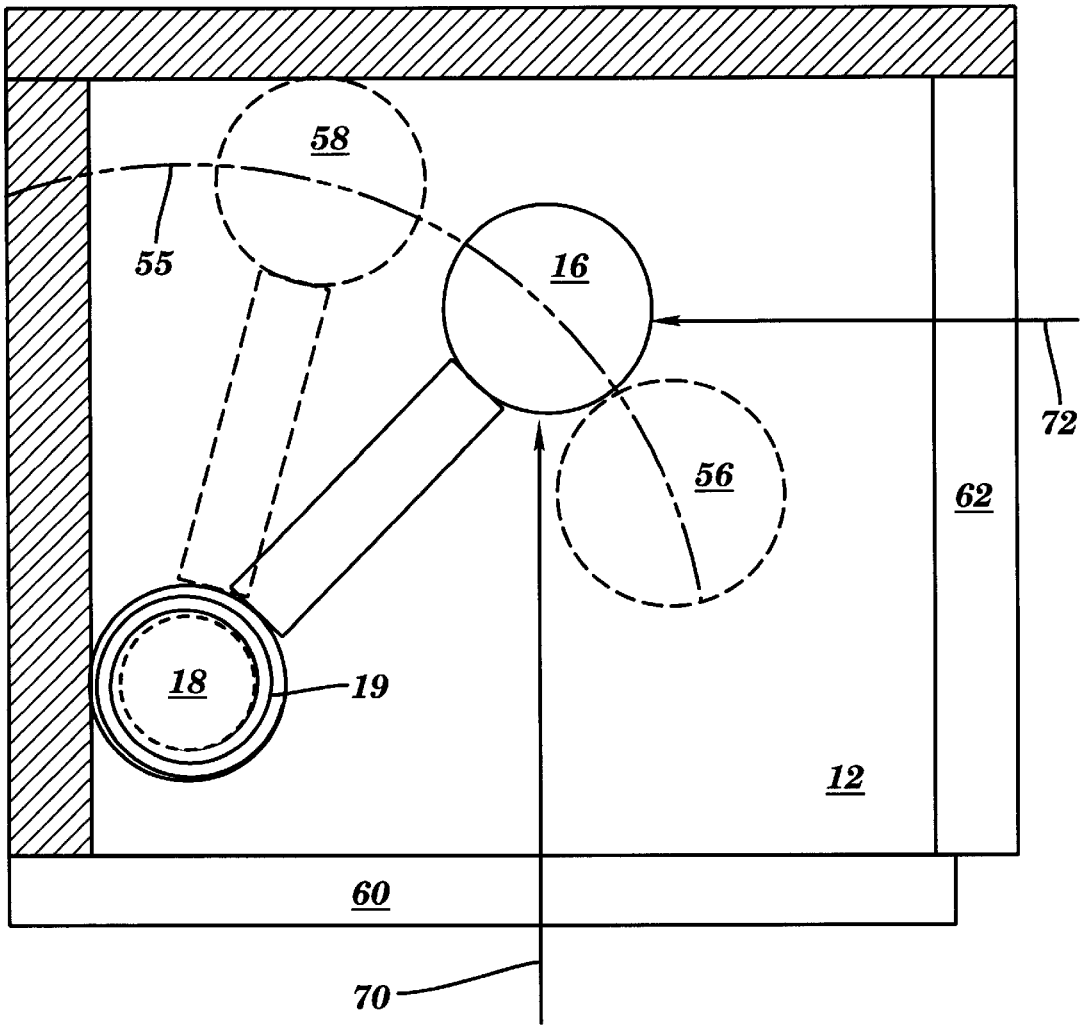
FIG. 4 depicts a top view of the receiving pocket of the locking mechanism in accordance with a preferred embodiment of the present invention.

Referring now to FIG. 4, a top view of receiving pocket 12 is depicted. Inside receiving pocket 12 is trigger 16 shown in the outward or neutral position (solid line) ready for receiving a gate tang 13 from either opening 60 or 62. A gate tang 13 may be inserted into the receiving pocket 12 either along arrow 70 or arrow 72, therefore allowing a single locking mechanism configuration to have multiple applications without altering the design.

Trigger 16 is situated in such a manner that it can be pushed back along arc 55 when the gate tang 13 is inserted from either opening 60 or 62. When such a force is applied, trigger 16 rotates about trigger shaft 18 and is spring biased back to the neutral position via spring mechanism 19. When a gate tang 13 is inserted into receiving pocket 12, trigger 16 is pushed back into receiving pocket 12 to an inner position 58 (dotted line), where it is held in position by the gate tang 13. When the trigger 16 is pushed back to the inner position 58, dead bolt 14 (not shown) is dropped down through the receiving pocket 12 and into cutout 56 which locks the gate tang 13 into place. It should be recognized that the trigger configuration depicted in FIG. 4 is just one example of a trigger configuration that can be actuated from a plurality of directions, and other configurations that achieve the same functionality are within the scope of this invention.

The foregoing description of the preferred embodiments to the invention have been presented for purposes of illustration and description, and are not intended to be exhaustive or to limit the invention to the precise form disclosed, and obviously many modifications and variations are possible in light of the above teachings. Such modifications and variations that may be apparent to a person skilled in the art are intended to be included within the scope of this invention as defined by the accompanying claims.

What is claimed is:

1. A locking mechanism, comprising:

a bolt oriented along a first axis and having range of motion constrained to said first axis, the bolt having a coupling mechanism affixed proximate an end; and a control lever having a first end and a second end, the control lever being pivotally movable relative to a pivot point located proximate the second end, the control lever further including an attachment system located proximate the first end for receiving the coupling mechanism;

wherein the attachment system allows the control lever to move the bolt along said first axis between a locked and an unlocked position, and restrains movement of the bolt from the locked to unlocked position when an external force is applied to the bolt and wherein the attachment system comprises a three-lobed opening for receiving a pin, wherein the three-lobed opening includes a first slot aligned between the first and second ends of the control lever, and a second slot aligned along said first axis.

2. The locking mechanism of claim 1, wherein the attachment system comprises a clutch that clutches the coupling mechanism and prevents the control lever from pivotally moving relative to the pivot point.

3. The locking mechanism of claim 1, wherein the coupling mechanism is a pin.

4. The locking mechanisnm of claim 1, wherein the control lever further comprises a spring for biasing the bolt toward the locked position.

5. A locking mechanism, comprising:

a receiving pocket for receiving a tang;

a bolt oriented along an axis through the receiving pocket, wherein the bolt has a first end that is positionable in either a locked or unlocked position within the receiving pocket, and wherein the bolt includes a pin affixed proximate a second end;

a control lever having a first end and a second end, the control lever being pivotally movable relative to a pivot point located proximate the second end, the control lever further including an opening located proximate the first end for receiving the pin, wherein the opening includes a first slot aligned between the first and second ends of the control lever, and a second slot aligned parallel said axis.

6. The locking mechanism of claim 5, wherein the receiving pocket includes a first opening capable of receiving the tang from either a first or second direction, wherein the first and second directions are perpendicular to each other.

7. The locking mechanism of claim 5, wherein the control lever is coupled to the bolt such that a force placed upon the first end of the bolt will not move the bolt from the locked to unlocked position.

8. The locking mechanism of claim 5, wherein the control lever is spring biased to force the bolt into the locked position.

9. The locking mechanism of claim 8, wherein movement of the control lever is controlled by a key mechanism, a solenoid, and a trigger located within the receiving pocket.

10. The locking mechanism of claim 6, further comprising a trigger located within the receiving pocket, wherein the trigger is configured such that it can be actuated by the tang in either the first or second direction.

11. The locking mechanism of claim 6, wherein a trigger is coupled to a rotatable shaft having a shaft pin, wherein the shaft pin impedes movement of the control lever when the trigger is in a neutral position.

* * * * *